US005507283A

United States Patent [19]

Grivas

[11] Patent Number: 5,507,283

[45] Date of Patent: Apr. 16, 1996

[54] SYSTEM FOR PROVIDING AIR TO THOSE TRAPPED WITHIN A BURNING BUILDING

[76] Inventor: Dimitrios E. Grivas, 540 W. Roscoe, #275, Chicago, Ill. 60657

[21] Appl. No.: 203,930

[22] Filed: Mar. 1, 1994

[51] Int. Cl.[6] ..... A62B 15/00; E06B 9/16

[52] U.S. Cl. ..... 128/205.25; 128/202.27; 128/204.18

[58] Field of Search ..... 128/205.25, 203.13, 128/206.25, 206.28, 207.12, 207.13, 202.27, 201.19, 201.22, 201.23, 201.24, 201.25, 202.27, 205.12, 204.18, 205.25, 206.12, 206.27

[56] References Cited

U.S. PATENT DOCUMENTS

| | | | |
|---|---|---|---|
| 839,486 | 12/1906 | LaFave | 128/202.13 |
| 2,299,793 | 10/1942 | Cannaday et al. | 128/202.13 |
| 4,054,084 | 10/1977 | Palmer | 98/39 |
| 4,373,522 | 2/1983 | Zien | 128/202.13 |
| 4,380,187 | 4/1983 | Wicks | 98/39 |
| 4,467,796 | 8/1984 | Beagley | 128/205.25 |
| 4,640,278 | 3/1987 | Barry | 128/206.27 |
| 4,703,808 | 11/1987 | O'Donnell | 167/91 |
| 4,905,684 | 3/1990 | Heffer | 128/202.13 |
| 4,928,583 | 5/1990 | Taylor et al. | 98/31 |
| 4,944,216 | 7/1990 | McCutcher | 98/33.1 |
| 5,063,924 | 11/1991 | Galvan et al. | 128/204.18 |
| 5,163,422 | 11/1992 | Burgess | 128/205.25 |
| 5,178,581 | 1/1993 | Del Monte | 454/239 |

*Primary Examiner*—Edgar S. Burr
*Assistant Examiner*—William J. Deane, Jr.
*Attorney, Agent, or Firm*—Patula & Associates

[57] ABSTRACT

A system for providing air to users trapped within a smoke-filled building includes a series of piping mounted to or built inside of the exterior wall of a building. The ground end of the piping has a ventilation mechanism which draw air through a screen and into the piping. At the user end, a breathing instrument is plugged into a breathing instrument connector which is attached to the piping, to provide air to the user. An intercom system is included for the user to communicate with rescuers. The piping has a decompression valve to relieve pressure built up in the system.

18 Claims, 1 Drawing Sheet

SYSTEM FOR PROVIDING AIR TO THOSE TRAPPED WITHIN A BURNING BUILDING

This invention relates to devices for providing air to those, either persons or animals, in a building which is on fire, particularly multi-story buildings and, even more particularly, to built-in systems which can be installed at relatively low cost into multi-story buildings units to avail air and communication access simultaneously to system users.

BACKGROUND OF THE INVENTION

Despite advances in health and safety requirements for residential buildings, for office buildings and for other multi-story facilities, one of the leading causes of health and safety hazard in the event of fire continues to be smoke inhalation. Lack of oxygen and the presence of noxious fumes caused by fire are additional hazards that threaten the health and lives of those trapped within burning buildings. A variety of inventions have been devised to attempt to eliminate the hazards of smoke inhalation, the presence of combustible gases, noxious fumes and the like, but these inventions do not avail a versatile, effective built-in system that can be implemented simply and quickly to help get air to persons or animals trapped within a burning building.

For example, in U.S. Pat. No. 4,703,808, issued to O'Donnell there is disclosed a smoke eliminator for removing smoke, heat and combustion gases from a burning structure. This device is comprised of a rigid tube having an adapter attached to one end and a fog nozzle attached to its other end. The adapter allows the device to be connected to a conventional fire hose at its base end. It is designed primarily for use by firefighters, with the intention that a firefighter insert the device into the window space of the burning building to aspirate smoke, heat and gases from the building while creating a fog curtain outside of the window to protect adjacent buildings or firefighters working outside of the burning building. This invention is not designed to get air to those trapped within the burning building.

Another invention, U.S. Pat. No. 4,380,187, issued to Wicks is designed specifically for providing air to persons entrapped within a burning building. This invention teaches a method and system for utilizing existing water pipes to feed air to trapped occupants. An actuator connected to a number of fire sensors within the building actuates a source of pressurized air through existing hot and cold water pipes upon detecting a fire. This air jet stream blasts existing water through the pipes, then provides an atmosphere of air at slightly elevated pressure in a pre-determined room, such as a bathroom. The presumed effect of this system is to provide air to the trapped inhabitants and to exclude smoke by the air pressure differential. The problem with this system is that it presumes the protected room will be available to those trapped within the burning building. This may not always be the case. Furthermore, rooms such as bathrooms frequently are not constructed near the outside wall of multi-story, multi-unit buildings, thereby drawing trapped inhabitants away from building exteriors where fire rescue teams might be likely to access the trapped inhabitant more easily.

Numerous other devices and systems attempt to address fire ventilation hazards by smoke evacuation systems, such as in U.S. Pat. Nos. 5,178,581 issued to Del Monte ("Smoke Evacuation System"), 4,054,084 issued to Palmer ("Fire and Smoke Free System For High Rise Building Stairways"), 4,944,216 issued to McCutcher ("Building Emergency Exhaust Fan System") and 4,928,583 issued to Taylor, et al. ("Air Flow System"), as well as Japanese Patent No. 2-143042 issued to Shinjaro Miyahara ("Fire-Preventative Smoke-Discharging Device"). However, these systems and devices again are designed to systematically remove smoke, heat and noxious fumes caused by fire within a burning building as opposed to feeding air to particular inhabitants trapped within a burning building.

One object of the present invention therefore is to provide a built-in system for providing air to those trapped within a burning building.

Another object of the present invention is to provide a built-in system for providing air to those trapped within a burning building which is easy to use and easy to install.

Another object of the present invention is to provide a dual use built-in system for providing air and communication access simultaneously to those trapped within a burning building.

Still another object of the present invention is to provide a system for providing air to those trapped within a burning building which is easy to manufacture and install, utilizing existing building interior spaces located between exterior building walls and interior building walls to thread life-saving air and communication channels.

Yet another object of the present invention is to provide a system for supplying air to those trapped within a burning building which utilizes existing building interior spaces located between exterior building walls and interior building walls to thread life-saving air and communication channels in multi-story, multi-unit buildings.

Still another object of the present invention is to provide a system for feeding air to those trapped within a burning building which puts the user in the position to be rescued more readily by firefighters or rescue team members by bringing the inhabitant closer to a building exterior.

Another object of the present invention is to provide a versatile built-in system for supplying air to those trapped within a burning building by including adaptations for dependent users such as infants and pets.

Numerous other advantages and features of the invention will become readily apparent from the detailed description of the preferred and alternative embodiments of the invention, from the claims, and from the accompanying drawings, in which like numerals are employed to designate like parts throughout.

SUMMARY OF THE INVENTION

A built-in system for supplying air to those trapped within a multi-story burning building comprised of a system of piping running from approximately two feet off of the ground level of the building all the way to the top floor of the building, with each vertical pipe set connected to a central fire station located on the outside of the building, said fire station having a power supply source and ventilation powering means to force air up through said piping in the event of fire to local area unit cabinets which can then be opened by a trapped inhabitant to access a breathing mask for air supply and intercom reception for communication with firefighters and the like working outside of the building. The system can be attached to the exterior walls of an existing building or built inside the walls of a newly constructed building.

BRIEF DESCRIPTION OF THE DRAWINGS

A fuller understanding of the foregoing may be had by reference to the accompanying drawings, wherein.

DETAILED DESCRIPTION OF THE INVENTION

Figure 1:
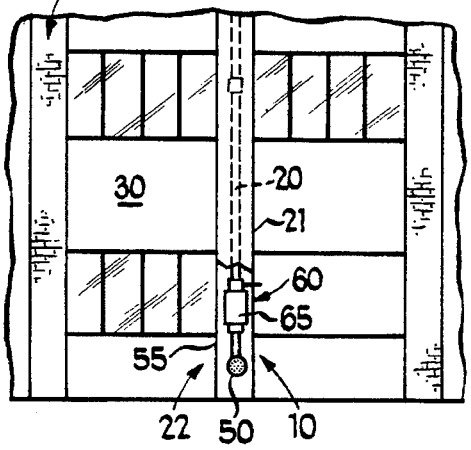
FIG. 1 is a side elevational view of an existing building containing the built-in system of the present invention attached to the exterior walls of the building.

While the invention is susceptible of embodiment in many different forms, there is shown in the drawings and will be described herein in detail, a preferred and alternate embodiment of the invention. It must be understood, however, that the present disclosure is to be considered an exemplification of the principles of the invention and is not intended to limit the spirit and scope of the invention and/or claims of the embodiments illustrated.

Referring now to the drawings generally, there is shown the preferred embodiment of the invention comprised of a system 10 built into the hollow spaces of a multi-story building 100, said system 10 comprised of vertical air-supply piping 20 having a ground end 22 and a user end 24, said piping 20 being installed on the exterior building surface 30 beginning approximately two feet above building ground level and extending to the top story of said building 100 wherein said piping 20 is capped off to prevent smoke within a burning building to infiltrate said piping 20. The piping 20 has a spring loaded decompression valve near its top end to release air sent through the piping when the pressure becomes too great. System 10 is further defined by a ball screen 50 at said building base 55 of said piping 20, a ventilation housing 60 for ventilation mechanism 65 which pumps air into said piping 20 in the event of fire, an intercom system 70 (see FIG. 4) for coordinating communications to building inhabitants through said piping 20, and a power source 80 for powering said intercom 70 and ventilation mechanism 65 in the event of fire to provide air and communication means for those trapped within the building in the event of fire by sucking air through said ball screen 50 and blowing it up through said vertical piping 20 to discrete user mask locations. An air decompression valve located on top of said vertical piping 20 decompresses air pressure built up in said piping 20 upon ventilation of said system 10.

In a new building, vertical air supply piping 20 is built into the walls integral with exterior wall 30 (see FIG. 8) so that the pipe is shielded from fire and cannot be burned. In this embodiment, the system 10 further includes horizontal piping 28 which branches off longitudinally from vertical air-supply piping 20 at a plurality of locations to deliver air to various locations on a floor.

Referring now to the drawings in particular, FIG. 1 discloses system 10 in use on an existing building 100. Vertical air-supply piping 20 is attached to the exterior building surface 30 and extends to the top of the building. At its ground end 22, vertical air-supply piping 20 comprises a ball screen 50 located near building base 55. Ball screen 50 is operatively connected to a ventilation housing 60 which contains a ventilation mechanism 65 which draws air through ball screen 50 and into piping 20. While screen 50 is illustrated as ball-shaped, it should be understood that screen 50 could be any shape or mechanism which would allow air to pass through while preventing foreign material from entering the system 10.

FIG. 1 (and FIGS. 2,3) further depicts pipe covering 21 suitably mounted over vertical air-supply piping 20. Pipe covering 21 is preferably a rigid, box-like fire-protecting housing which surrounds piping 20 and is suitably mounted to the exterior building surface 30. Besides insulating piping 20 from fire and the elements, covering 21 further hides the piping 20 from view, thereby providing a more aesthetically pleasing appearance of the invention on the outside of the building. It should be understood however that pipe covering 21 is preferred, but need not be utilized in the operation of the present invention. When used, pipe cover 21 can be designed to match the building surface, i.e. by having a brick design when used on a brick building for example.

Figure 2:
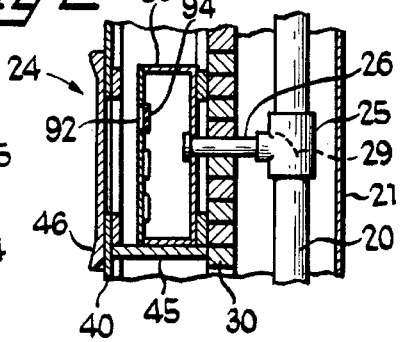
FIG. 2 is a partial cut-away view of a wall section of the building in which the present invention is installed.

FIG. 2 illustrates the user end 24 of system 10. As can be seen, a local area unit cabinet 45 is built into interior building surface 40, in the interior space between exterior surface 30 and interior surface 40. Vertical air-supply piping 20 branches off at pipe coupling 25, where a short horizontal connector pipe 26 leads into cabinet 45. Connector pipe 26 preferably has an air diverter 29 or funnel at the end connected to pipe coupling 25 so as to more readily direct air into pipe 26 from pipe 20 to cabinet 45.

Inside cabinet 45, connector pipe 26 connects to breathing instrument connector 90. Breathing instrument connector 90 comprises a plurality of access opening 92 in which breathing instruments can be selectively attached. When not in use, openings 92 are sealed by diaphragms 94. Breathing instrument connector 90 is accessed through door 46 of cabinet 45.

Figure 3:
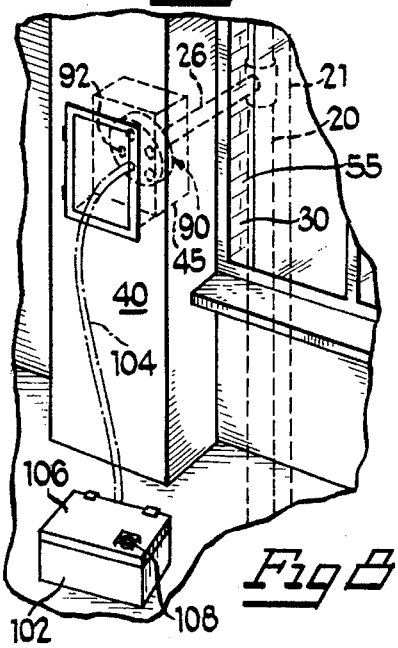
FIG. 3 is a perspective view of a unit cabinet located in a building which would allow the built-in system to be accessed for air or communication.

FIG. 3 shows a perspective view of system 10 with cabinet 45 built into interior wall 40, and piping 20 built onto exterior wall 30. Connector pipe 26 connects piping 20 to cabinet 45 and provides air to breathing instrument connector 90 having access openings 92.

Also seen in FIG. 3 is a breathing instrument in the form of a lifebox 102 which connects to an air access opening 92 in breathing instrument connector 90 via an air hose 104. Lifebox 102 is an air-tight, fireproof box with a hinged cover 106 in which a pet or dependent user may be placed to receive air drawn through piping 20. Lifebox 102 is preferably for infants, pets or other inhabitants incapable of voluntarily connecting themselves to a breathing instrument. Lifebox 102 preferably has a spring loaded decompression valve 108 which automatically opens when pressure in the box becomes too great, thereby relieving the pressure. Infants, pets or other dependents who would require breathing assistance not adaptable to another breathing instrument or breathing mask 110 (See FIG. 6), could be placed temporarily and safely within the lifebox 102 with life-sustaining air provided therein until rescue team members were available to remove the inhabitant from the burning building. Lifebox 102 could be any size or shape.

Figure 4:
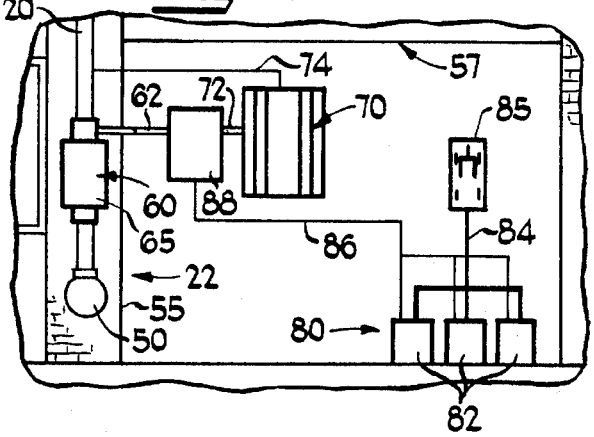
FIG. 4 is a partial front view of the fire station control which powers the present invention.

FIG. 4 shows the central fire station 57 of system 10. Station 57 is preferably an enclosed housing located at building base 55 near ground end 22 of piping 20. Station 57 preferably has a locked access with the building engineer and firemen having a key to unlock the station and gain access.

Inside fire station 57 is located power source 80 of system 10. Power source 80 runs ventilation mechanism 65 and intercom system 70. Power source 80 is preferably a set of three batteries 82. Batteries 82 are connected via an electrical communicator 84 to an automatic voltage regulator 85 which recharges the batteries automatically. Batteries 82 are further connected via an electrical communicator 86 to a panel distributor 88. Panel distributor 88 distributes power to run both the ventilation mechanism 65 and intercom system 70.

Also seen in FIG. 4 are ball screen 50 ventilation housing 60, and intercom system 70. Ventilation mechanism 65 in housing 60 is connected to panel distributor 88 via electrical communicator 62. Intercom system 70 is connected to panel distributor 88 via electrical communicator 72. Intercom system 70 is connected with breathing instrument connector 90 via an electrical communicator 74 run through piping 20.

Figure 5:
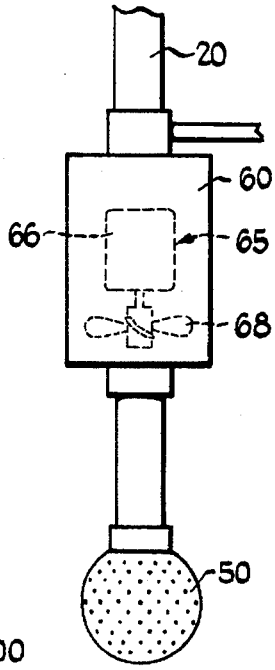
FIG. 5 is a side elevation view of the ball screen and ventilation housing of the present invention.

FIG. 5 shows the ventilation mechanism 65 in housing 60 of the present invention. Ventilation mechanism 65 comprises a motor 66 operatively connected to a fan 68. Motor 66 runs fan 68 to draw air through screen 50 and up through piping 20 to provide air to trapped inhabitants of the building.

Figure 6:
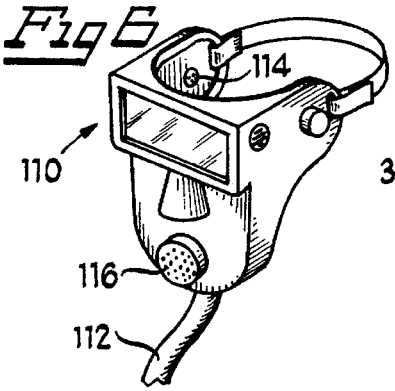
FIG. 6 is a perspective view of a user mask showing ventilation and communication means including ear phones and microphone component.

FIG. 6 shows a breathing instrument of the present invention illustrated as a breathing mask 110. Breathing mask 10 connects to an air access opening 92 of breathing instrument connector 90 via air hose 112 to deliver air to a user wearing the mask. Mask 110 further includes earphones 114 and a speaker 116 which connect to intercom system 70 via breathing instrument connector 90.

Figure 7:
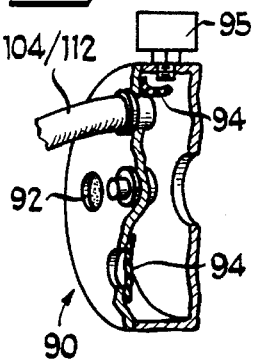
FIG. 7 is a partially broken away perspective view of the breathing instrument connector of the present invention.

Breathing instrument connector 90 is shown in FIG. 7. Connector 90 is a circular box-like housing connected to pipe 26 and including a plurality of air access openings 92 having diaphragms 94. Connector 90 is capable of receiving one or more breathing instruments, including masks 110 or life boxes 102 or any combination thereof. Breathing instrument air hoses 104 and 112 are plugged into air access openings 92 whereupon diaphragms 94 open to provide air to the user of the breathing instrument. Diaphragms 94 can be any suitable air valves or air chokes which open upon connection of the air hoses by any suitable means.

One of the air access openings 92, preferably distinguished by color coding, contains the intercom system contact which operatively connects earphone 114 and speaker 116 of mask 110 to intercom system 70. While more than one mask and/or air access openings could contain intercom hook-ups, it is preferable that only one mask and one access opening at each local area unit cabinet 45 contain intercom means. A decompression valve 95 is further depicted on top of connector 90.

Figure 8:
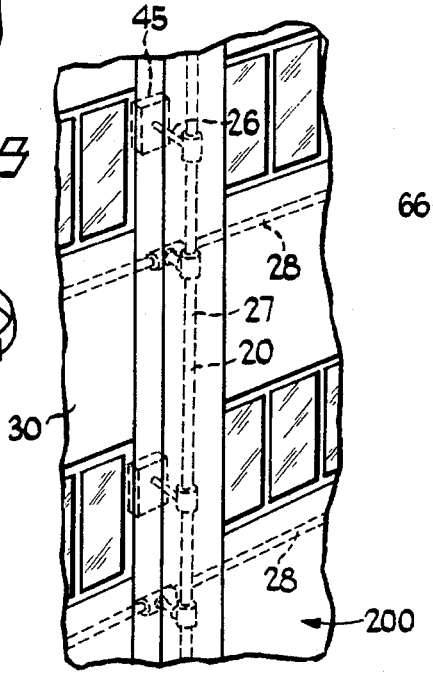
FIG. 8 is a perspective view of a new building containing the built-in system of the present invention built inside the walls of the building.

FIG. 8 illustrates system 10 constructed inside the exterior walls of a new building 200. In this embodiment, vertical air-supply piping 20 comprises a single main air-supply pipe 27 on each side of the building, which branches off at each floor via horizontal piping 28 to provide air to each local area unit cabinets 45. The remaining aspects of the system are the same or similar with the possible exception of size and/or magnitude of the system. Since the piping 20 and 28 are hidden inside the exterior walls of the building, horizontal piping linked to one main pipe 27 is preferable. While the system shown in FIG. 1 could have horizontal piping branching from a main pipe, it is more aesthetically pleasing to have several vertical pipes on each side of the building rather than horizontal piping since the piping is attached to the outside of the building.

In operation, during an emergency such as a fire, a user obtains a breathing instrument such as mask 110, opens cabinet 45, and plugs in hose 112 into air access opening 92, thereby opening diaphragm 94. Upon connection, system 10 automatically begins operation. Alternatively, system 10 is activated by the building engineer or a fireman from the fire station 57 upon notification of an emergency.

Power source 80, illustrated as, but not limited to rechargeable batteries 82, provides power to ventilation mechanism 65 and intercom system 70. Motor 66 runs fan 68 which draws air through screen 50, up piping 20 and to each local area unit cabinet 45 via pipes 26 and 28, and to any user of a breathing instrument connected to connector 90. The user connected to the air access opening having intercom contact can communicate to a person at fire station 57 via intercom system 70, and thus provide vital information such as floor location and severity of the situation at that location, including the number of users at that location. The firestations 57 could have a flashing light which would indicate which station is presently in use.

In small buildings or structures, such as single family homes, it should be understood that firestation 57 and/or ventilation system 65 need not be incorporated into the present invention. The relatively short distance for the air to be drawn can be achieved directly by breathing through a breathing instrument without the aid of the ventilation system.

The benefits of such a system are enormous. Besides the immediate life saving benefits of users, the system provides greater safety to firefighters who may not need to go rushing into a burning, smoke-filled building. Further, insurance companies and building owners would benefit enormously in the number of insurance claims filed, the severity of the claims, and the cost of insurance policies. Further, families, individuals, or others might be more inclined to rent or buy an apartment or space in a building having such a safety system.

It is to be understood that the embodiments herein described are merely illustrative of the principles of the present invention. Various modifications may be made by those skilled in the art without departing from the spirit or scope of the claims which follow.

I claim:

1. A system for providing air to users trapped within a smoke-filled building, consisting of:

air access means for providing non-pressurized air to said users, said air access means having a ground end and at least one user end, said at least one user end being at a higher elevation than said ground end;

at least one breathing instrument selectively attachable to said user end of said air access means; and said air access means including at least one air conduit extending from said user end down to said ground end and opening to said non-pressurized air, non-pressurized air being in fluid communication from said ground end to said user end via said air conduit without any mechanically activated means for forcing air flow;

said air conduit comprises air-supply piping;

said air-supply piping is a main vertical pipe mounted between an exterior building surface and an interior building surface, said main vertical pipe having at least one horizontal pipe branching therefrom.

2. The system of claim 1, wherein said air conduit includes a ball screen for preventing foreign material from entering said system at said ground end where said air conduit opens to said non-pressurized air.

3. The system of claim 1, wherein said at least one user end of said air access means comprises a breathing instrument connector means for providing air to said at least one breathing instrument upon connection of said at least one breathing instrument thereto.

4. The system of claim 3, wherein said breathing instrument connector means is a box-like housing having a plurality of air access openings therein.

5. The system of claim 4, wherein said plurality of air access openings include selectively openable and closeable diaphragms.

6. The system of claim 4, wherein said at least one breathing instrument connects to one of said plurality of air access opening to provide air to said at least one breathing instrument.

7. The system of claim 1, wherein said at least one breathing instrument is a breathing mask.

8. The system of claim 1, wherein said at least one breathing instrument is a lifebox.

9. The system of claim 1, wherein said system further includes an intercom system.

10. The system of claim 9, wherein said intercom system is powered by a power source located at a base of said building.

11. The system of claim 1, wherein said air access means includes a decompression valve.

12. The system of claim 1, wherein said air-supply piping includes a pipe housing cover enclosing said piping between said housing cover and said building.

13. A system for providing air to users trapped within a smoke-filled building, consisting of:

a vertical air-supply piping, said piping having at least one user end and a ground end opening to non-pressurized air, said at least one user end being at a higher elevation than said ground end, said piping providing fluid communication of non-pressurized air from said ground end to said user end;

said air-supply piping is a main vertical pipe mounted between an exterior building surface and an interior building surface, said main vertical pipe having at least one horizontal pipe branching therefrom;

a breathing instrument connector operatively connected to said user end of said piping, said breathing instrument connector including a plurality of air access openings having selectively openable and closeable diaphragms; and at least one breathing instrument selectively attachable to said breathing instrument connector to provide air to a user.

14. The system of claim 13, wherein said system further comprises an intercom system, said intercom system including a speaker and an earphone in said breathing instrument and operatively connected via a contact in said breathing instrument connector to a means for communicating at said ground end.

15. A system for providing air to users trapped Within a smoke-filled building, consisting of:

a main vertical air-supply pipe mounted inside an exterior wall of said building, said vertical pipe having a ground end opening to non-pressurized air and a plurality of user ends, said user ends connected to said vertical pipe by horizontal pipes running from said vertical pipe to said user ends, said plurality of user ends being at a higher elevation than said ground end, said main vertical pipe and said horizontal pipes providing fluid communication of non-pressurized air from said ground end to said user ends independent from any device for initiating air flow;

a breathing instrument connector operatively connected to said user ends of said pipe, said breathing instrument connector including a plurality of air access openings having selectively openable and closeable diaphragms; and at least one breathing instrument selectively attachable to said breathing instrument connector to provide air to a user.

16. The system of claim 15, wherein said system further comprises an intercom system.

17. A method for providing air to those trapped within a smoke-filled building using a system comprising main and branched piping, a breathing instrument connector, and at least one breathing instrument, said method comprising the steps of:

providing said main piping from a ground area to a user area at a higher elevation than said ground area;

mounting said main piping between an exterior building surface and an interior building surface;

opening said main piping at said ground area to non-pressurized air;

branching said main piping at said user area;

providing a breathing instrument connector on said branched piping at said user area;

connecting said breathing instrument to said breathing instrument connector; and enabling fluid communication of said non-pressurized air from said ground end through said main and branched piping to said breathing instrument without any need for air forcing devices.

18. A building structure having means for selectively accessing atmospheric air for emergency use in said building structure in the absence of breathable air therein, said building structure comprising:

a plurality of outside walls, said plurality of outside walls each including an interior wall section and an exterior wall section, said interior and exterior wall section defining an area therebetween;

a network of vertical air-supply piping mounted in said area between said interior and exterior wall sections, each of said plurality of vertical air-supply piping extending from an air receiving opening at a ground end to at least one user end at a higher elevation than said ground end and providing fluid communication of non-pressurized air therethrough;

said ground end of each of said plurality of vertical piping opening to non-pressurized air at said air receiving opening;

said air receiving opening having a screen cover for preventing foreign material from entering said air receiving opening;

said at least one user end of each of said plurality of vertical air supply piping including a breathing instrument connector having a plurality of air access openings;

said at least one user end of each of said plurality of vertical air-supply piping including at least one breathing instrument selectively attachable to said at least one air access opening of said breathing instrument connector for allowing non-mechanically dependent fluid communication between said air receiving opening of said ground end and said breathing instrument.

* * * * *